US009352605B1

(12) United States Patent
Corey

(10) Patent No.: US 9,352,605 B1
(45) Date of Patent: May 31, 2016

(54) ONE-PIECE EXPANDABLE POCKET

(71) Applicant: Thomas J. Corey, Buffalo, NY (US)

(72) Inventor: Thomas J. Corey, Buffalo, NY (US)

( * ) Notice: Subject to any disclaimer, the term of this patent is extended or adjusted under 35 U.S.C. 154(b) by 0 days.

(21) Appl. No.: 14/489,922

(22) Filed: Sep. 18, 2014

(51) Int. Cl.
*B42F 7/08* (2006.01)

(52) U.S. Cl.
CPC ..... *B42F 7/08* (2013.01)

(58) Field of Classification Search
CPC ..... B42F 7/02; B42F 7/06; B42F 7/08; A45C 1/06; B42P 2241/06
USPC ..... 229/67.1–67.4
See application file for complete search history.

(56) References Cited

U.S. PATENT DOCUMENTS 295,949 A 4/1884 Sewell
1,956,325 A * 4/1934 Hart ..... B42F 19/00 229/67.3
2,330,402 A * 9/1943 Winokar ..... B42F 7/06 229/67.3
2,505,994 A 5/1950 Sahula
2,726,030 A 12/1955 Levin
3,063,619 A * 11/1962 Rhoten ..... B42F 5/005 206/311
3,073,508 A * 1/1963 Hiersteiner ..... B65D 31/10 229/67.3
3,368,735 A 2/1968 Levi
3,552,640 A * 1/1971 Young ..... B65D 5/0005 229/67.3
3,570,752 A 3/1971 Sczesniak
3,643,858 A 2/1972 Deckys
4,830,268 A * 5/1989 Pitts ..... B42F 15/04 229/67.1
4,867,319 A * 9/1989 Arner ..... B42F 15/0094 211/46
4,971,361 A * 11/1990 Whiting ..... B42C 7/002 281/15.1
4,989,777 A 2/1991 Miller
5,362,299 A 11/1994 Schou
5,558,221 A 9/1996 Scior
5,711,750 A 1/1998 Christensen et al.
5,720,427 A 2/1998 Kachel et al.
7,900,814 B2 3/2011 McBride
2008/0237077 A1 10/2008 Sage
2009/0114704 A1 5/2009 Howlett
2012/0018500 A1 1/2012 Kinzy

OTHER PUBLICATIONS http://www.fibermark.com/products/genuine-pressboard, printed Apr. 29, 2014.

* cited by examiner

*Primary Examiner* — Nathan J Newhouse
*Assistant Examiner* — Peter Helvey
(74) *Attorney, Agent, or Firm* — Simpson & Simpson, PLLC

(57) ABSTRACT

An expandable pocket, including only a single sheet of material having A) a front panel, B) a back panel, C) a pleated spine extending along a pocket bottom and, on a first side, connected to the front panel along the front length and, on a second side, connected to the back panel along the back panel length, the spine further extending to form a first pocket side, and a second pocket side, D) a first wing connected to the spine or the front panel and, on a first face, secured to a front panel face, E) a second wing connected to the spine or the back panel and, on a first face, secured to a back panel face, F) a first back tab secured between the back panel and the second wing, and G) a first front tab secured between the front panel and the first wing.

11 Claims, 7 Drawing Sheets

ONE-PIECE EXPANDABLE POCKET

FIELD OF THE INVENTION

The present invention relates to expandable pockets and, in particular, expandable pockets formed by folding a single sheet of material.

BACKGROUND OF THE INVENTION

Expandable pockets made of multiple pieces of material, such as a front panel, a back panel, and an accordion-pleated spine to fasten the panels together are known. However, such multi-piece folders are relatively difficult to manufacture. For example, multi-piece, expandable folders are hand-assembled by gluing the front and back panels to the spine, which decreases the rate of production. An additional drawback of conventional multi-piece folders arises during use. For example, when the folder is filled with documents or other materials, tears occur at stressed locations, particularly glued locations such as where the panels are adjoined to the spine.

U.S. Pat. No. 5,711,750 to Christensen et al. and U.S. Pat. No. 5,720,427 to Kachel et al. assigned to Smead Manufacturing Company, and hereinafter referred to as "the Smead patents," disclose a plurality of embodiments of reinforced expandable pockets. According to one of the embodiments, disclosed in FIGS. 21 and 22, a pocket is manufactured by folding a single sheet of material. The pocket shown in FIG. 22, comprises a front cover 242 formed by two side panels 202 and 204, and a short panel 210, and a back panel formed by two side panels 206 and 208 and a short panel 214. Short panel 210 is located between the side panels 202 and 204, and the side panels and short panel are glued together to form the front cover; similarly, short panel 214 extends between the side panels 206 and 208, and the side panels and short panel are glued together to form the back cover. The short panels each extend from the spine and extend along the entire length of the bottom of the pocket.

BRIEF SUMMARY OF THE INVENTION

A disadvantage of an expandable folder configured as described in the Smead patents is that the short panel, which is glued and extends along the bottom of the pocket, is subjected to some of the greatest amounts of stress during use of the pocket. Such a design subjects a weak aspect of the folder to some of the greatest amount of stress. Aspects of the present invention are directed to one-piece folders having improved durability.

According to an aspect of the invention an expandable pocket comprises a single sheet of material comprising A) a front panel forming a front of the pocket, having a front panel length and a front panel width, B) a back panel forming a back of the pocket, having a back panel length and a back panel width, C) a pleated spine extending along a bottom of the pocket and, on a first side of the spine, connected to a first side of the front panel along the front panel length (on the bottom of the pocket) and, on a second side of the spine, connected to a first side of the back panel along the back panel length (on the bottom of the pocket), the spine further extending along a second side of the front panel and a second side of the back panel in the direction of the front panel width and the back panel width to form a first pocket side, and extending along a third side of the front panel and a third side of the back panel in the direction of the front panel width and the back panel width to form a second pocket side, D) a first wing connected to one of the spine and the front panel and, on a first face of the first wing, secured to a face of the front panel, E) a second wing connected to one of the spine and the back panel and, on a first face of the second wing, secured to a face of the back panel, F) a first back tab connected to a back side of the first pocket side and secured between the back panel and the second wing, and G) a first front tab connected to a front side of the second pocket side and secured between the front panel and the first wing.

In some embodiments, the first wing has a first side of the first wing connected to the first spine portion on the first side of the spine, and the second wing has a first side of the second wing connected to second spine portion on the second side of the spine.

In some embodiments, the first wing is connected to a forth side of front panel that is opposite the first side of the front panel and the second wing is connected to a forth side of back panel that is opposite the first side of the back panel.

The front panel and first wing may be a same size and a same shape as each other such that the faces of the front panel and the first wing are coextensive, and/or the back panel and second wing may be a same size and a same shape as each other such that the faces of the back panel and the second wing are coextensive.

In some embodiments, at least one of the face of the front panel and the face of the second panel is an exterior face.

In some embodiments, at least one of the face of the front panel and the face of the second panel is an interior face.

In some embodiments, the pocket further comprises H) a second back tab connected to a back side of the second pocket side and secured between the back panel and the second wing, and I) a second front tab connected to a front side of the first pocket side and secured between the front panel and the first wing.

According to another aspect of the invention an expandable pocket, comprises a single sheet material comprising A) a pleated spine having a spine length and a spine width, B) a front panel having a first side connected to the spine on a first side of the spine along the spine length, the front panel having a front panel length and a front panel width, C) a back panel having a first side connected to the spine on a second side of the spine along the spine length, the back panel having a back panel length and a back panel width, the front panel and the back panel extending over a same central portion of the spine length, the spine length extending beyond the central portion at a first end to form a first spine portion and at a second end to form a second spine portion, D) a first tab connected to the first spine portion on the second side, E) a second tab connected to the second spine portion on the first side, F) a first wing having a first side that is connected to one of (1) the first spine portion on the first side of the spine and (2) a second side of the front panel that is opposite the first side of the front panel, and G) a second wing having a first side that is connected to one of (1) the second spine portion on the second side of the spine and (2) a second side of the back panel that is opposite the first side of the back panel. The sheet of material is folded such that front panel faces the back panel to partially form a pocket interior and the front panel and the back panel defining a pocket front and a pocket back, respectively, and folded such that the first spine portion faces the second spine portion and further forms the pocket interior, and the first spine portion and the second spine portion defining a first pocket side and a second pocket side, respectively. A first face of the first wing faces a face of the front panel and is secured thereto. The second tab is secured between the first wing and the front panel. A first face of the second wing faces a face of the back panel and is secured thereto. The first tab is secured between the second wing and the back panel.

The term "secured", as the term is used herein, means attached directly or indirectly using a glue, other adhesive material or other techniques of attaching. The term "connected", as the term is used herein, means bordering and forming a continuous sheet of material therewith.

BRIEF DESCRIPTION OF THE SEVERAL VIEWS OF THE DRAWING

The nature and mode of operation of the present invention will now be more fully described in the following detailed description of the invention taken with the accompanying drawing figures, in which.

DETAILED DESCRIPTION OF THE INVENTION

Figure 1:
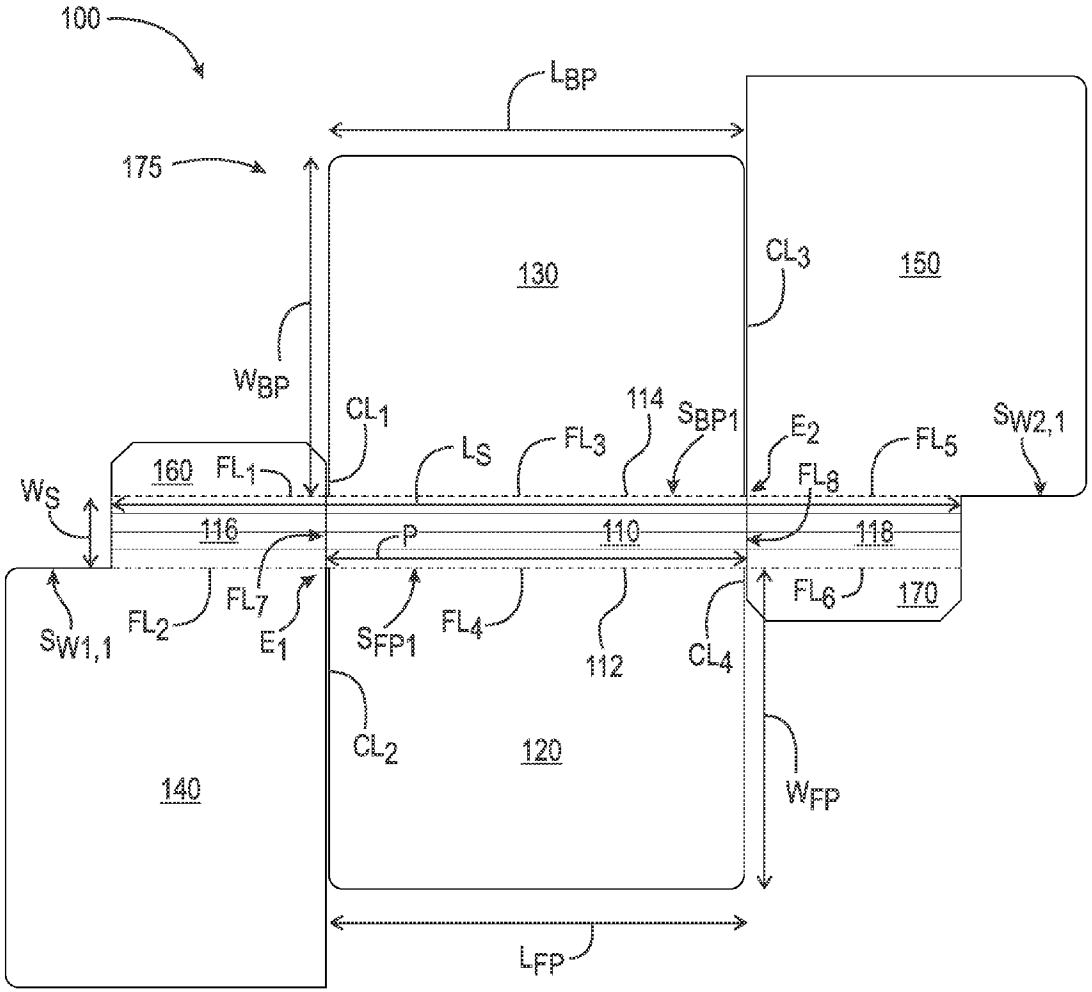
FIG. 1 is a plan view of an example of an embodiment of an expandable pocket blank according to aspects of the present invention in an unfolded state.

FIG. 1 is a plan view of an example of an embodiment of an expandable pocket blank 100 according to aspects of the present invention, in an unfolded state. Expandable pocket blank 100, comprises a single sheet material 175, that has been shaped, cut in selected locations, and otherwise processed (e.g., by adding fold lines) to facilitate folding to form an expandable pocket.

Single sheet of material 175 comprises a pleated spine 110, a front panel 120, a back panel 130, a first wing 140, a second wing 150, a first tab 160 and a second tab 170. The shapes of these components are apparent from the plan view. In the illustrated embodiment, the components are generally rectangular but may have other shapes. Cut lines $CL_1$, $CL_2$, $CL_3$ and $CL_4$ are added, as shown, to facilitate movement of the components relative to one another during folding to produce a pocket. Fold lines $FL_1$, $FL_2$, $FL_3$, $FL_4$, $FL_5$, $FL_6$, $FL_7$ and $FL_8$ are present to facilitate folding at designated locations. Other than at locations identified as cut lines, the sheet of material remains intact as a single sheet. Accordingly, it is to be appreciated that, although sheet of material 175 has been modified as set forth above, the components of the sheet remain connected at selected locations so as to remain a single sheet of material after the blank is formed (shown in FIG. 1) and after the blank is folded to form a finished pocket (shown in FIG. 4).

Pleated spine 110 has a spine length $L_S$ and a spine width $W_S$. Pleated spine 110 can be constructed in any suitable manner. For example, pleat formation may be facilitated by forming fold lines in the material. For example, fold lines may be formed by milling, scoring or cutting.

Front panel 120 having a first side $S_{FP1}$ that is connected to the spine 110 on a spine first side 112 along the spine length $L_S$. The front panel has a front panel length $L_{FP}$ and a front panel width $W_{FP}$. Back panel 130 having a first side $S_{BP1}$ that is connected to the spine 110 on a spine second side 114 along the spine length $L_S$. Back panel 130 has a back panel length $L_{BP}$ and a back panel width $W_{BP}$.

Front panel 120 and back panel 130 extend over a same central portion P of the spine length $L_S$. Spine length $L_S$ extends beyond central portion P at a first end $E_1$ to form a first spine portion 116. The spine length $L_S$ extends beyond the portion P at a second end $E_2$ to form a second spine portion 118.

First tab 160 is connected to first spine portion 116 on second side 114 of the spine. The second tab 170 is connected to second spine portion 118 on first side 112 of the spine.

In the illustrated embodiment, first wing 140 has a first side $S_{W1,1}$ that is connected to first spine portion 116 on first side 112, opposite first tab 160; and second wing 150 has a first side $S_{W2,1}$ that is connected to second spine portion 118 on second side 114, opposite the second tab 170.

Although in the illustrated embodiment first wing 140 and second wing 150 are shown as connected to spine 110, as discussed with reference to FIGS. 5, 6 and 7 below, first wing 140 and second wing 150 may instead be connected to front panel 120 and back panel 130, respectively.

Single sheet of material 175 may comprise a conventional heavy stock paper (e.g., 30, 25 or 20 point pressboard) or any other suitable material for the manufacture of expandable pockets. The spine, including its portions 116 and 118, forms a continuous portion of sheet of material 175; and front panel 120, back panel 130, first wing 140, second wing 150, first tab 160 and second tab 170 are connected to the spine to form continuous portions of the sheet of material 175 so as to maintain the single piece construction. Front panel 120 and first wing 140 may be the same size and shape as each other such that, after folding in the manners set forth herein, the faces of the front panel and the first wing are coextensive; and similarly, the back panel 130 and second wing 150 may be the same size and shape as each other such that, after folding, the faces of the back panel and the second wing are coextensive.

Figure 2:
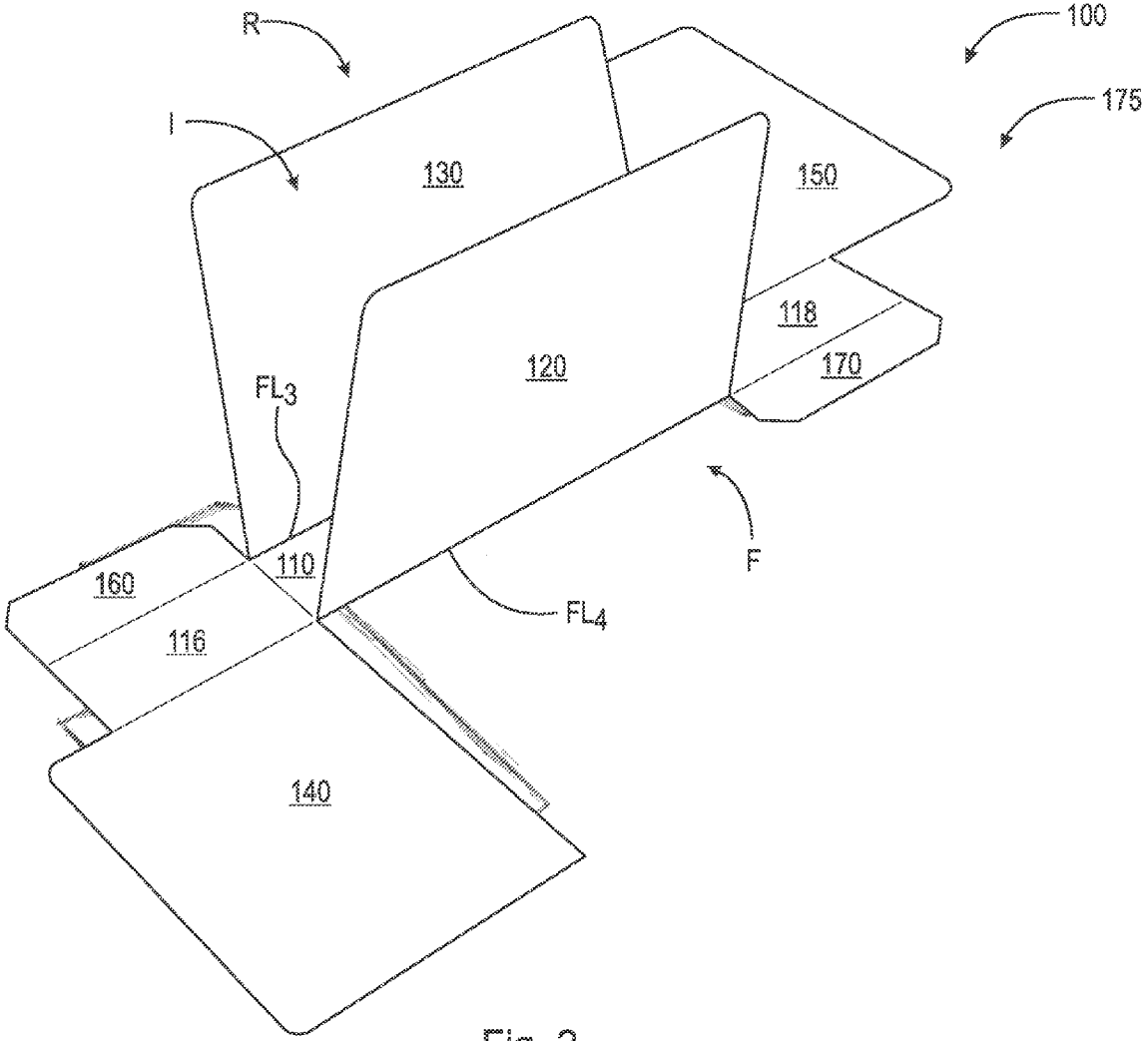
FIGS. 2-3 are schematic illustrations of the expandable folder blank of FIG. 1 in a partially-folded states.
Figure 3:
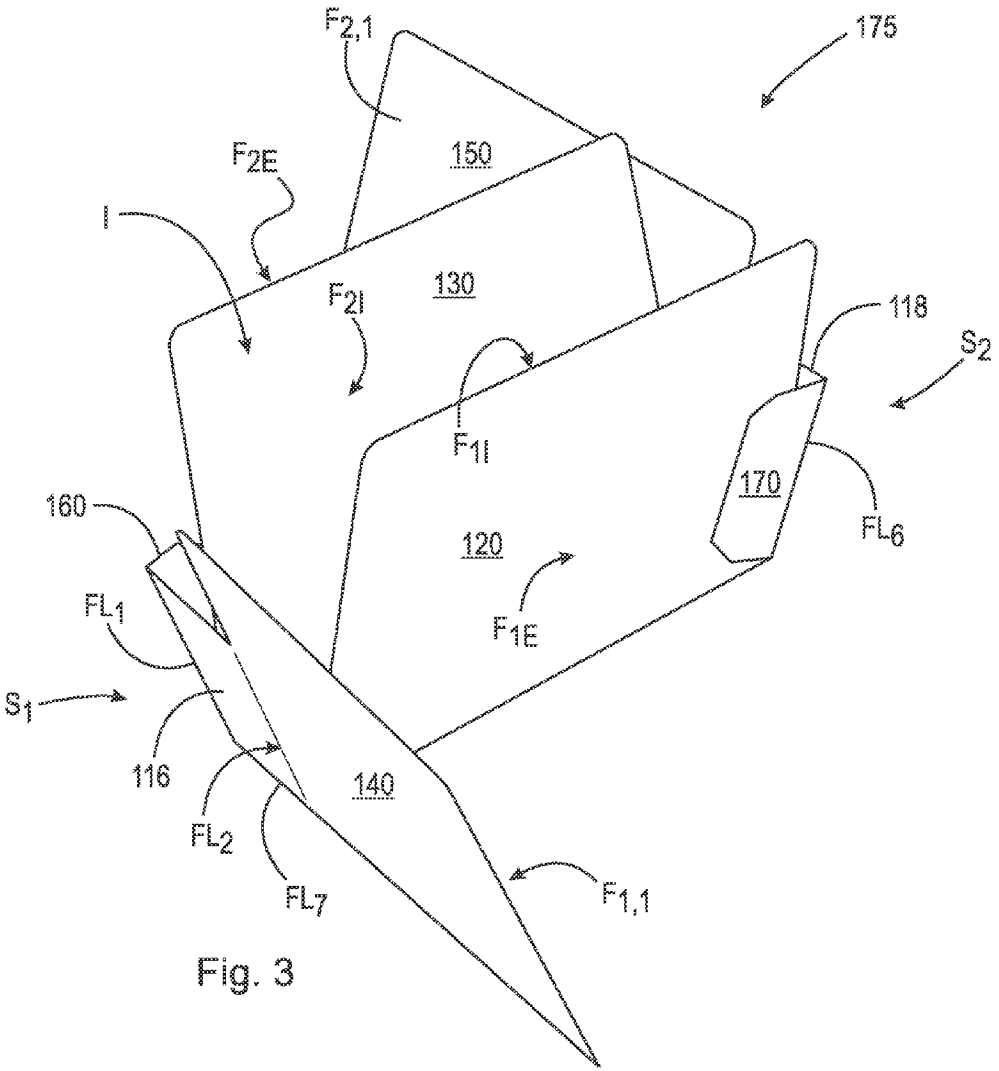

FIGS. 2-3 are schematic illustrations of expandable pocket blank 100 of FIG. 1 in a partially-folded state. As illustrated in FIG. 2, sheet of material 175 is folded about fold lines $FL_3$ and $FL_4$) such that front panel 120 faces the back panel 130 to partially form a pocket interior I, and to define a pocket front F and a pocket back R, respectively. As illustrated in FIG. 3, the sheet of material 175 is further folded about fold lines $FL_7$ and $FL_8$ (shown in FIG. 1) such that the first spine portion 116 faces the second spine portion 118 and further forms pocket interior I. First spine portion 116 and second spine portion 118 define a first pocket side $S_1$ and a second pocket side $S_2$, respectively.

First wing 140 is folded along fold line $FL_2$ such that a first face $F_{1,1}$ of first wing 140 faces an exterior face $F_{1E}$ of the front panel 120 and is secured thereto. Second tab 170 is folded along fold line $FL_6$ so as to extend between the first wing 140 and the front panel 120, and is secured between the first wing and the front panel. Similarly, second wing 150 is folded along fold line $FL_5$ (shown in FIG. 1) such that a first face $F_{2,1}$ of the second wing 150 faces an exterior face $F_{E2}$ of the back panel 130 and is secured thereto. The first tab 160 is folded along fold line $FL_1$ so as to extend between the second wing 150 and the back panel 130, and is secured between the second wing and the back panel.

Figure 4:
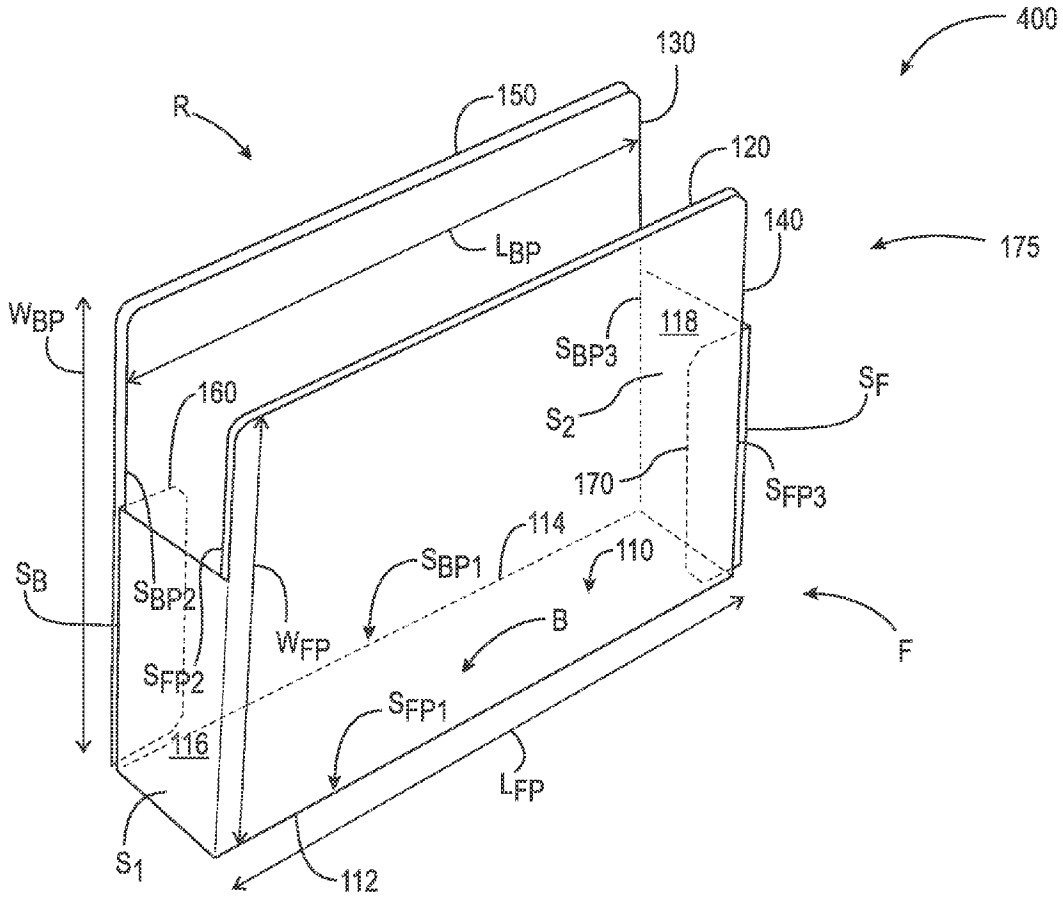
FIG. 4 is an expandable folder formed by folding the blank of FIG. 1.

FIG. 4 is an expandable pocket 400 formed from the blank 100 of FIG. 1. Expandable pocket 400 comprises single sheet of material 175 that has been folded and secured as indicated above. The front panel 120 forms front F of the pocket, having front panel length $L_{FP}$ and front panel width $W_{FP}$. The back panel 130 forms back R of the pocket, having back panel length $L_{BP}$ and back panel width $W_{BP}$.

Pleated spine 110 extends along bottom B of the pocket and is connected, on first side 112 of the spine, to first side $S_{FP1}$ of front panel 120 along front panel length $L_{FP}$ and, is connected on a second side 114 of the spine to first side $S_{BP1}$ of the back panel 130 along the back panel length $L_{BP}$. Spine 110 further extends, along a second side $S_{FP2}$ of the front panel and a second side $S_{BP2}$ of the back panel in the direction of the front panel width $W_{FP}$ and the back panel width $W_{BP}$ to form a first pocket side $S_1$. The spine also extends along a third side $S_{FP3}$ of the front panel and a third side $S_{BP3}$ of the back panel in the direction of the front panel width $W_{FP}$ and the back panel width $W_{BP}$ to form a second pocket side $S_2$.

First wing 140 is secured on a first face $F_{1,1}$ (shown in FIG. 3) to an exterior face (also referred to as an outer face) $F_{1E}$ (shown in FIG. 3) of the front panel. Second wing 150 is secured on a first face $F_{2,1}$ to an outer face $F_{2E}$ of the back panel. As indicated above, although in the illustrated embodiment first wing 140 and second wing 150 are shown as connected to spine 110, as discussed with reference to FIGS. 5 and 6 below, first wing 140 and second wing 150 may be connected to front panel 120 and back panel 130, respectively. As indicated above, first wing 140 is connected to the first spine portion 116 on the first side 112, opposite the first tab 160; and the second wing 150 extends along the second spine portion 118 on the second side 114, opposite the second tab 170.

First tab 160 is connected to a back side $S_B$ of the first pocket side $S_1$ and is secured between the back panel 130 and the second wing 150.

Second tab 170 is connected to a front side $S_F$ of the second pocket side $S_2$ and is secured between the front panel 120 and the first wing 140.

Although in FIGS. 3 and 4, first wing 140 is folded to face an exterior face $F_{1E}$ of the front panel, in some embodiments, the first wing 140 is folded to face an interior face $F_{1I}$ (shown in FIG. 3) of the front panel, and second tab 170 extends between and is secured between the first wing and the front panel; and although, in said figures, second wing 150 is folded to face an exterior face $F_{2E}$ (shown in FIG. 3) of the back panel, in some embodiments, the second wing 150 is folded to face an interior face $F_{2I}$ of the back panel, and first tab 160 extends between and is secured between the second wing and the back panel.

Figure 5:
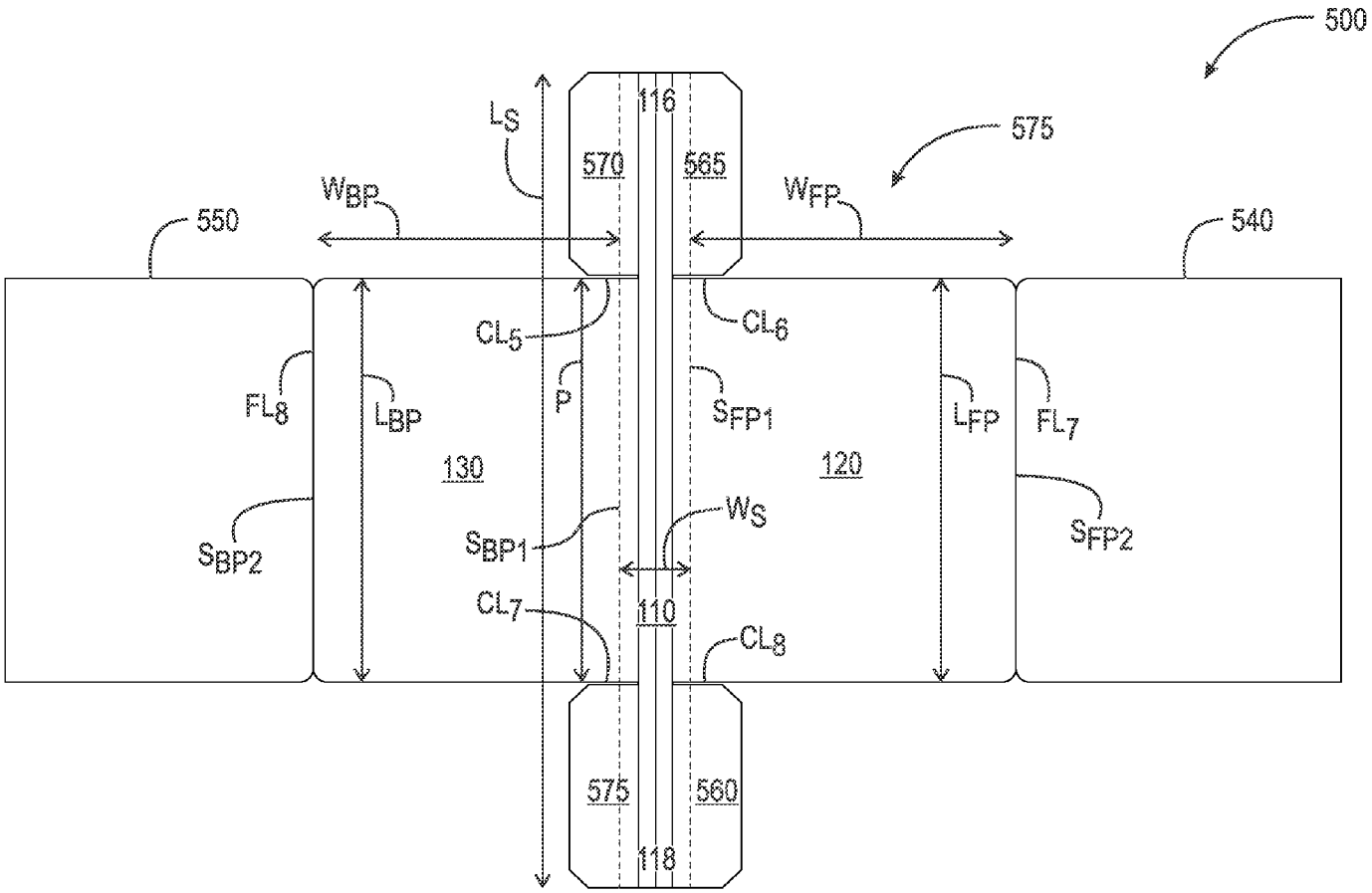
FIG. 5 is a plan view of another example of an embodiment of an expandable pocket blank according to aspects of the present invention in an unfolded state.
Figure 6:
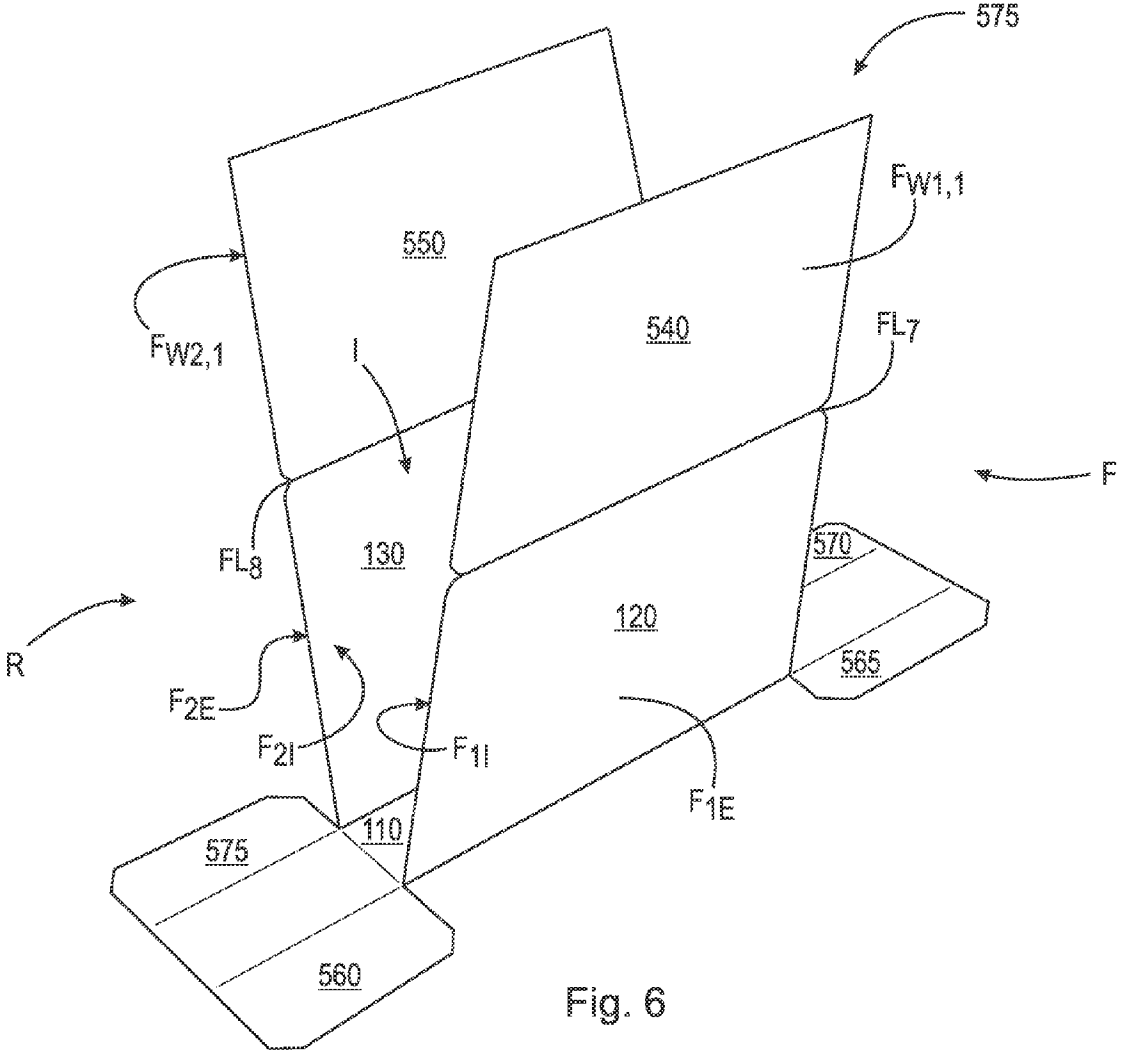
FIG. 6 is a schematic illustration of the expandable folder blank of FIG. 5 in a partially-folded state.
Figure 7:
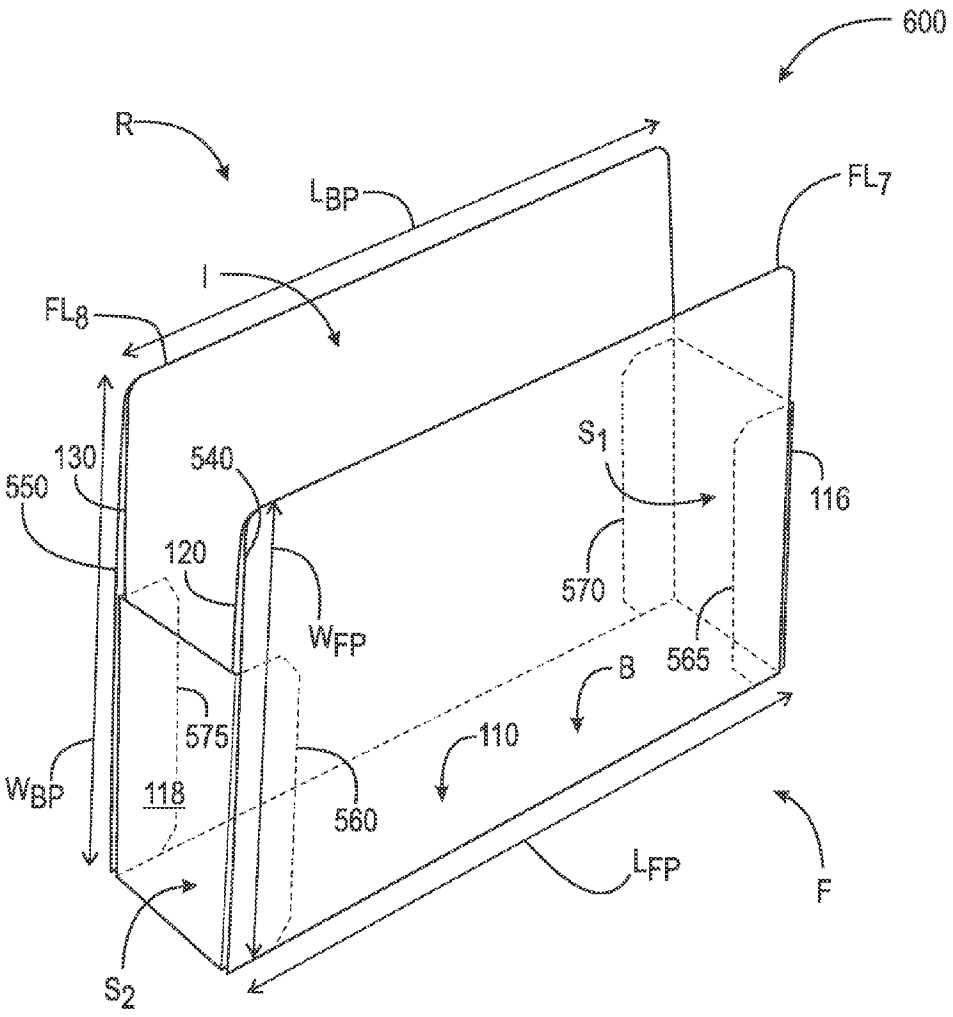
FIG. 7 is an expandable folder formed from by folding the blank of FIG. 5.

FIGS. 5, 6 and 7 will be referred to together in the following discussion of another example of an embodiment 500 of an expandable pocket blank and a folder 600 according to aspects of the present invention. Like the embodiment illustrated in FIG. 1, expandable pocket comprises a single sheet material 575. Blank 500 is similar to blank 100 (shown in FIG. 1) in regards other than those set forth below, including that rather than first wing 540 being connected to first spine portion 116, first wing 540 is connected to a side $S_{FP2}$ of front panel 120 that is opposite the first side $S_{FP1}$ of the front panel (i.e., opposite where the front panel is connected to the spine) and rather than second wing 550 being connected to second spine portion 118, second wing 550 is connected to a side $S_{BP2}$ of back panel 130 that is opposite the first side $S_{BP1}$ of the back panel (i.e., opposite where the back panel is connected to the spine). Cut lines $CL_5$, $CL_6$, $CL_7$, $CL_8$ facilitate folding of components to form a folder.

Sheet of material 575 is folded such that front panel 120 faces the back panel 130 to partially form a pocket interior I (shown in FIG. 6), and to define a pocket front F and a pocket back R, respectively. The sheet of material 575 is further folded such that the first spine portion 116 faces the second spine portion 118 to further form pocket interior I (shown in FIG. 7). First spine portion 116 and second spine portion 118 define a first pocket side $S_1$ and a second pocket side $S_2$, respectively.

First wing 540 is folded along a fold line $FL_7$ such that first face $F_{W1,1}$ of the first wing 540 faces an exterior face $F_{1E}$ of the front panel and is secured thereto. First front tab 560 and second front tab 565 each extend between and are secured between the first wing 540 and the front panel 120. Similarly, second wing 550 is folded along a fold line $FL_8$ such that a first face $F_{W2,1}$ of the second wing 550 faces an exterior face $F_{2E}$ of the back panel and is secured thereto. First back tab 570 and second back tab 575 each extend between and are secured between the second wing 550 and the back panel 130. Although in the illustrated embodiment two back tabs and two front tabs are present, in some embodiments according to this aspect of the invention (e.g., where the wings are connected to respective panels), only one front tab (e.g., tab 560) and one back tab (e.g., tab 570) are present.

Spine 110, including its portions 116 and 118, forms a continuous portion of sheet of material 575; and the front panel 120, back panel 130, tabs 560, 565, 570 and 575 are connected to the spine to form continuous portions of the sheet of material 575, and first wing 540, second wing 550 are connected to the front panel and second panel, respectively, to form continuous portions of the sheet of material 575. Accordingly, the single-sheet construction is maintained.

Although, in the illustrated embodiment, first wing 540 is folded to face an exterior face $F_{1E}$ of the front panel, in some embodiments, the first wing 540 is folded to face an interior face $F_{1I}$ of the front panel, and front tabs 560 and 565 extend between and are secured between the first wing 540 and the front panel 120; and although, in the illustrated embodiment, second wing 550 faces an exterior face $F_{2E}$ of the back panel, in some embodiments, the second wing 550, is folded to face an interior face $F_{2I}$ of the back panel, and back tabs 570, 575 extend between and secured between the second wing and the back panel.

What is claimed is:

1. An expandable pocket, comprising:

a single sheet material comprising

A) a pleated spine having a spine length and a spine width,

B) a front panel having a first side connected to the spine on a first side of the spine along the spine length, the front panel having a front panel length and a front panel width, C) a back panel having a first side connected to the spine on a second side of the spine along the spine length, the back panel having a back panel length and a back panel width, the front panel and the back panel extending over a same central portion of the spine length, the spine length extending beyond the central portion at a first end to form a first spine portion and at a second end to form a second spine portion, D) a first tab connected to the first spine portion on the second side, E) a second tab connected to the second spine portion on the first side, F) a first wing having a first side that is connected to one of (1) the first spine portion on the first side of the spine and (2) a second side of the front panel that is opposite the first side of the front panel, and G) a second wing having a first side that is connected to one of (1) the second spine portion on the second side of the spine and (2) a second side of the back panel that is opposite the first side of the back panel, the sheet of material folded such that front panel faces the back panel to partially form a pocket interior and the front panel and the back panel defining a pocket front and a pocket back, respectively, and folded such that the first spine portion faces the second spine portion and further forms the pocket interior, and the first spine portion and the second spine portion defining a first pocket side and a second pocket side, respectively, a first face of the first wing facing a face of the front panel and secured thereto, the second tab secured between the first wing and the front panel, and a first face of the second wing facing a face of the back panel and secured thereto, the first tab secured between the second wing and the back panel.

2. The pocket of claim 1, wherein the first side of the first wing is connected to the first spine portion on the first side of the spine, and the first side of the second wing is connected to the second spine portion on the second side of the spine.

3. The pocket of claim 1, wherein the first side of the first wing is connected to the second side of front panel that is opposite the first side of the front panel and the first side of the second wing is connected to the second side of back panel that is opposite the first side of the back panel.

4. The pocket of claim 1, wherein the front panel and first wing are a same size and a same shape as each other such that the face of the front panel and the first face of the first wing are coextensive, and the back panel and second wing are a same size and a same shape as each other such that the face of the back panel and the first face of the second wing are coextensive.

5. The pocket of claim 1, wherein at least one of the face of the front panel and the face of the back panel is an exterior face.

6. The pocket of claim 1, wherein at least one of the face of the front panel and the face of the back panel is an interior face.

7. The pocket of claim 1, further comprising H) a third tab connected to the first side of the first spine portion and secured between the back panel and the second wing, and I) a fourth tab connected to the second side of the second spine portion and secured between the front panel and the first wing.

8. The pocket of claim 2, wherein at least one of the face of the front panel and the face of the back panel is an exterior face.

9. The pocket of claim 2, wherein at least one of the face of the front panel and the face of the back panel is an interior face.

10. The pocket of claim 3, wherein at least one of the face of the front panel and the face of the back panel is an exterior face.

11. The pocket of claim 3, wherein at least one of the face of the front panel and the face of the back panel is an interior face.

* * * * *